US011644769B2

(12) United States Patent
Soda

(10) Patent No.: US 11,644,769 B2
(45) Date of Patent: May 9, 2023

(54) IMAGE FORMING APPARATUS

(71) Applicant: KYOCERA Document Solutions Inc., Osaka (JP)

(72) Inventor: Tomohisa Soda, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/687,495

(22) Filed: Mar. 4, 2022

(65) Prior Publication Data

US 2022/0291608 A1 Sep. 15, 2022

(30) Foreign Application Priority Data

Mar. 11, 2021 (JP) ..... JP2021-039505

(51) Int. Cl.
*G03G 15/08* (2006.01)

(52) U.S. Cl.
CPC ..... *G03G 15/0887* (2013.01)

(58) Field of Classification Search
CPC ..... G03G 15/0887
See application file for complete search history.

(56) References Cited

U.S. PATENT DOCUMENTS 11,112,726 B2 * 9/2021 Soda ..... G03G 15/0868
2019/0187603 A1 6/2019 Soda

FOREIGN PATENT DOCUMENTS

JP 2019-109326 A 7/2017

* cited by examiner

*Primary Examiner* — Walter L Lindsay, Jr.
*Assistant Examiner* — Geoffrey T Evans
(74) *Attorney, Agent, or Firm* — Stein IP, LLC

(57) ABSTRACT

An image forming apparatus includes first and second conveying members arranged with an axial angle, for conveying toner in first and second containers, and a conveying driving portion. The conveying driving portion includes a motor, a first gear, a second gear, a third gear, a swing gear, an idle gear, and a fourth gear. The second gear is fixed coaxially with the rotary shaft of the second conveying member. The swing gear swings on the outer circumference of the first gear rotated by a motor and meshes selectively with one of the second and third gears. The idle gear meshes with the third and fourth gears. The fourth gear has an axial angle between its input and output shafts and is fixed coaxially with the rotary shaft of the first conveying member.

5 Claims, 7 Drawing Sheets

IMAGE FORMING APPARATUS

INCORPORATION BY REFERENCE

This application is based upon and claims the benefit of priority from the corresponding Japanese Patent Application No. 2021-039505 filed on Mar. 11, 2021, the contents of which are hereby incorporated by reference.

BACKGROUND

The present disclosure relates to an image forming apparatus.

As image forming apparatuses of an electrophotographic type such as copiers and printers, there are known devices that develop, using developer, an electrostatic latent image formed on the surface of a photosensitive drum as an image carrying member to form a toner image that is then transferred to a sheet.

For example, a conventional image forming apparatus includes a first toner container and a second toner container that store toner to be supplied to a single developing device. In such an image forming apparatus, when one container is empty, it is possible to supply toner from the other container to the developing device. This helps reduce the number of times of the image forming operation being stopped due to the replacement of the toner container and the time spent for it.

SUMMARY

According to one aspect of what is disclosed herein, an image forming apparatus includes a developing device, a first container, a second container, and a toner supply device. The developing device supplies toner to an image carrying member. The first container and second containers store the toner to be supplied to the developing device. The toner supply device supplies the toner in the first and second containers to the developing device. The toner supply device includes a supply pipe, a first conveying pipe, a second conveying pipe, a first conveying member, a second conveying member, and a conveying driving portion. The supply pipe is a single supply pipe that is connected to the developing device and through which the toner flows into the developing device. The first conveying pipe is connected between the first container and the supply pipe and through which the toner is conveyed from the first container toward the supply pipe. The second conveying pipe is connected between the second container and the supply pipe and through which the toner is conveyed from the second container toward the supply pipe. The first conveying member is rotatably arranged in the first conveying pipe and conveys the toner from the first container toward the supply pipe. The second conveying member is rotatably arranged in the second conveying pipe and conveys the toner from the second container toward the supply pipe. The conveying driving portion rotates selectively one of the first and second conveying members. The rotary shaft of the first conveying member and the rotary shaft of the second conveying member are arranged so as to form a predetermined axial angle. The conveying driving portion includes a motor, a first gear, a second gear, a third gear, a swing gear, an idle gear, and a fourth gear. The motor rotates the first and second conveying members. The first gear is fixed to the output shaft of the motor. The second gear is fixed coaxially with the rotary shaft of the second conveying member. The third gear is arranged away from, parallel to, the second gear. The swing gear meshes with the first gear and in addition meshes selectively with one of the second and third gears by swinging on the outer circumference of the first gear. The idle gear meshes with the third gear. The fourth gear has the axial angle between its input and output shafts and is fixed coaxially with the rotary shaft of the first conveying member to mesh with the idle gear.

DETAILED DESCRIPTION

Embodiments of the present disclosure will be described below with reference to the accompanying drawings. The present disclosure is, however, not limited to what is specifically described below.

Figure 1:
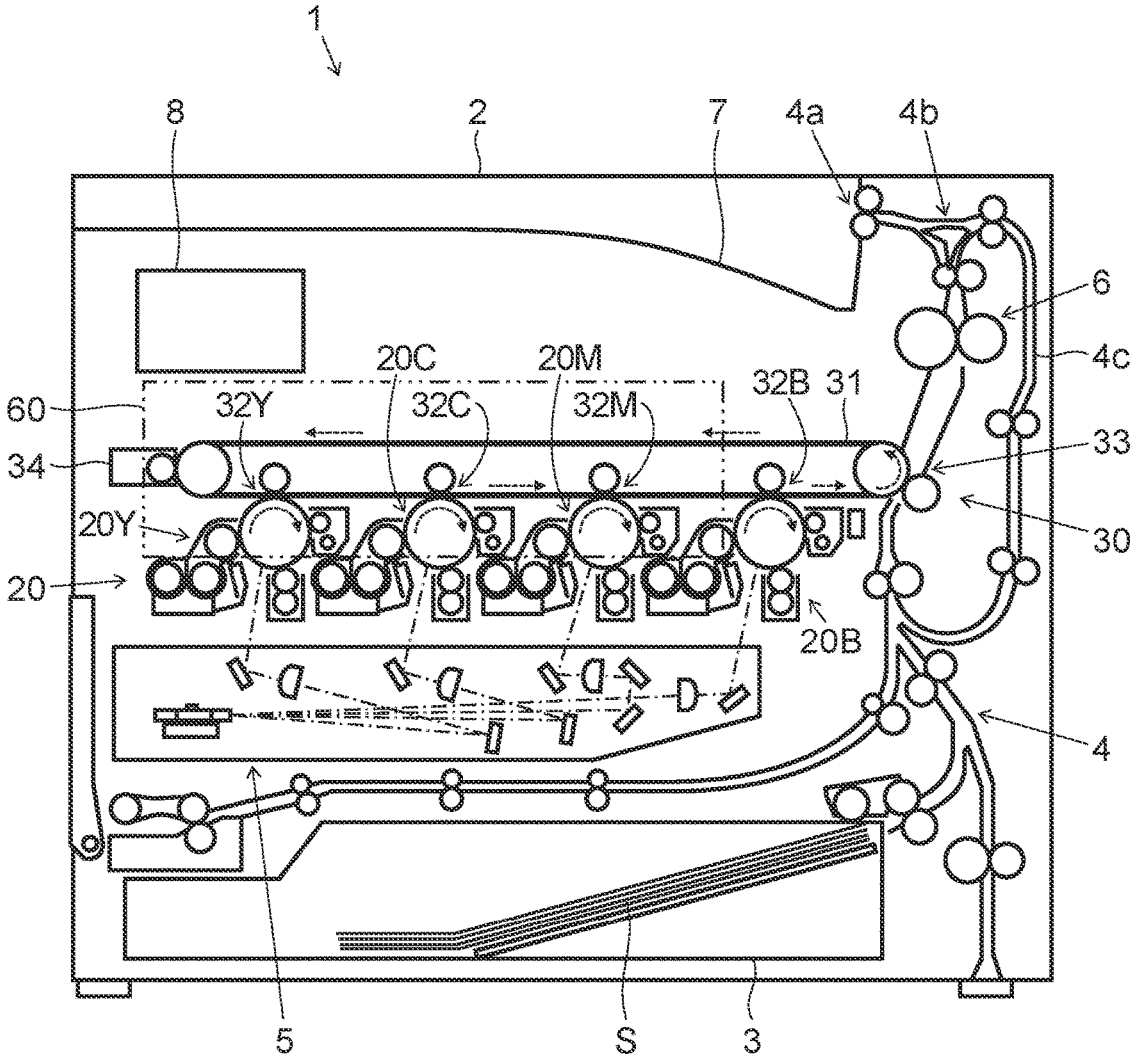
FIG. 1 is a schematic sectional front view of an image forming apparatus according to an embodiment of the present disclosure.
Figure 2:
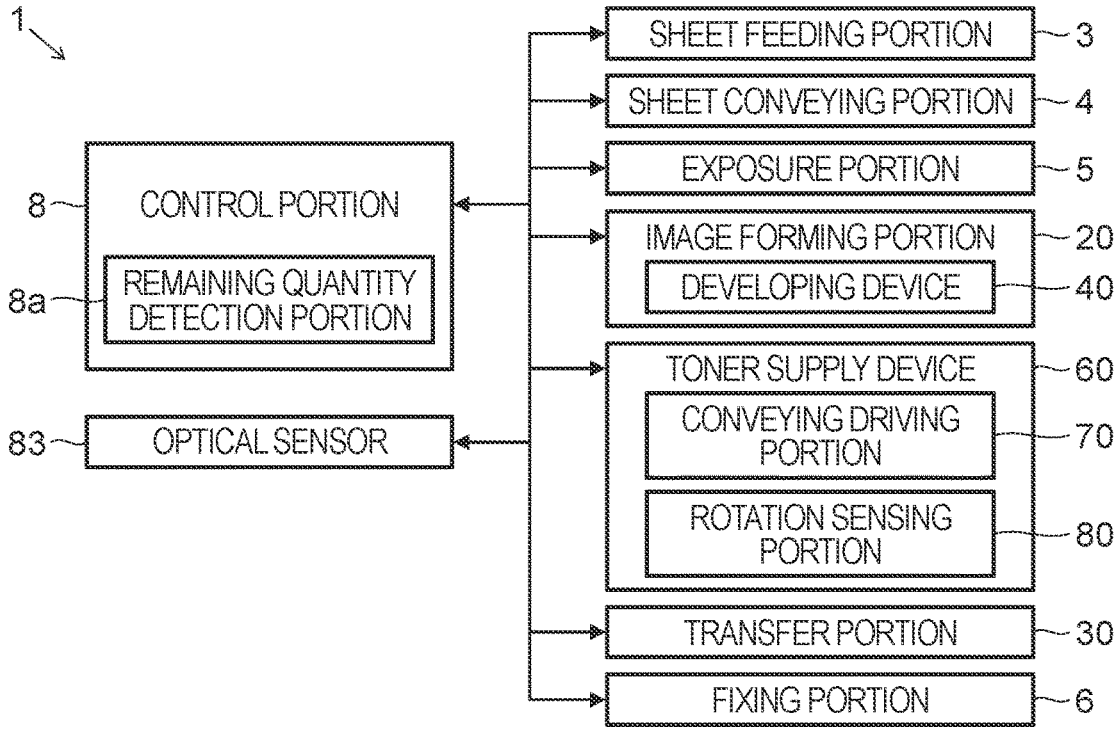
FIG. 2 is a block diagram showing an outline of the construction of the image forming apparatus in FIG. 1.
Figure 3:
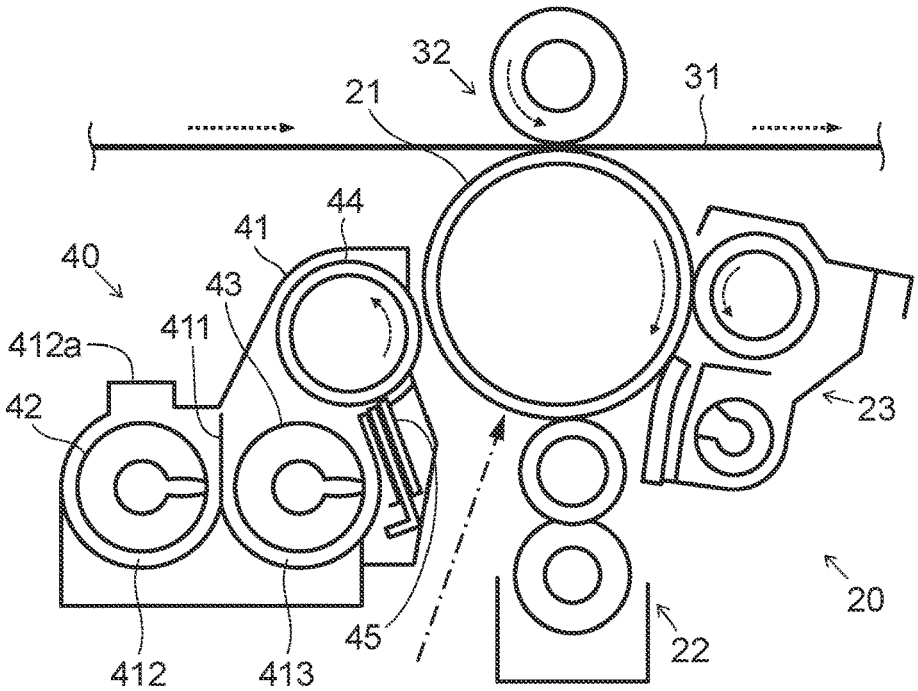
FIG. 3 is a schematic sectional front view of and around an image forming portion in the image forming apparatus in FIG. 1.

FIG. 1 is a schematic sectional front view of an image forming apparatus 1 according to an embodiment. FIG. 2 is a block diagram showing an outline of the construction of the image forming apparatus 1 in FIG. 1. FIG. 3 is a sectional view of and around an image forming portion 20 in the image forming apparatus 1 in FIG. 1. One example of the image forming apparatus 1 according to the embodiment is a color printer of a tandem-type which transfers a toner image onto a sheet S using the intermediate transfer belt 31. The image forming apparatus 1 may be what is called a multifunction peripheral provided with the functions of, for example, printing, scanning (image reading), and facsimile transmission.

As shown in FIGS. 1, 2, and 3, the image forming apparatus 1 includes, in its main body 2, a sheet feeding portion 3, a sheet conveying portion 4, an exposure portion 5, the image forming portion 20, a transfer portion 30, a fixing portion 6, a sheet discharge portion 7, and a control portion 8.

The sheet feeding portion 3 stores a plurality of sheets S and, during printing, feeds them out one after another separately. The sheet conveying portion 4 conveys a sheet S fed out from the sheet feeding portion 3 to a secondary transfer portion 33 and then to the fixing portion 6, and then discharges the sheet S after fixing through a sheet discharge port 4*a* to the sheet discharge portion 7. When two-side printing is performed, the sheet conveying portion 4 switches, with a branch portion 4*b*, the conveying direction of the sheet S after fixing on its first side to an inverting conveying portion 4*c*, and conveys the sheet S to the secondary transfer portion 33 and then to the fixing portion 6 once again. The exposure portion 5 shines, toward the image forming portion 20, laser light that is controlled based on image data.

The image forming portion 20 is arranged under the intermediate transfer belt 31. The image forming portion 20 includes an image forming portion for yellow 20Y, an image forming portion for cyan 20C, an image forming portion for magenta 20M, and an image forming portion for black 20B. These four image forming portions 20 have basically similar structures. Thus, in the following description, the letters "Y", "C", "M", and "B" distinguishing different colors may be omitted unless distinction is needed.

As shown in FIG. 3, the image forming portion 20 includes a photosensitive drum (image carrying member) 21 that is supported so as to be rotatable in a predetermined direction (clockwise in FIG. 3). The image forming portion 20 further includes, arranged around the photosensitive drum 21 along its rotation direction, a charging portion 22, a developing device 40, and a drum cleaning portion 23. A primary transfer portion 32 is arranged between the developing device 40 and the drum cleaning portion 23.

The photosensitive drum 21 has a photosensitive layer around its outer circumferential face. The charging portion 22 electrically charges the outer circumferential face of the photosensitive drum 21 to a predetermined potential. The exposure portion 5 exposes to light the outer circumferential face of the photosensitive drum 21 charged by the charging portion 22 to form on it an electrostatic latent image of the document image. The developing device 40 attaches toner to the electrostatic latent image to form a toner image. The four image forming portions 20 form toner images of different colors respectively. After the toner image is primarily transferred to the outer circumferential face of the intermediate transfer belt 31, the drum cleaning portion 23 performs cleaning by removing toner and the like left on the outer circumferential face of the photosensitive drum 21. In this way, the image forming portion 20 forms an image on the sheet S.

As shown in FIG. 1, the transfer portion 30 includes an intermediate transfer belt 31, primary transfer portions 32Y, 32C, 32M, and 32B, a secondary transfer portion 33, and a belt cleaning portion 34. The intermediate transfer belt 31 is arranged above the four image forming portions 20. The intermediate transfer belt 31 is an intermediate transfer member which is supported so as to be rotatable in a predetermined direction (counter-clockwise in FIG. 1) and to which the toner images formed on the four image forming portions 20 are sequentially superposed on each other and thereby primarily transferred. The four image forming portions 20 are arranged in what is called a tandem formation in which they are arranged in a row from upstream to downstream in the rotation direction of the intermediate transfer belt 31.

The primary transfer portions 32Y, 32C, 32M, and 32B are arranged across the intermediate transfer belt 31 over the image forming portions for different colors 20Y, 20C. 20M, and 20B. The secondary transfer portion 33 is arranged upstream of the fixing portion 6 in the sheet conveying direction in the sheet conveying portion 4 and downstream of the image forming portions for different colors 20Y, 20C, 20M, and 20B in the rotation direction of the intermediate transfer belt 31 in the transfer portion 30. The belt cleaning portion 34 is arranged upstream of the image forming portions for different colors 20Y, 20C, 20M, and 20B in the rotation direction of the intermediate transfer belt 31.

A toner image is primarily transferred to the outer circumferential face of the intermediate transfer belt 31 in the primary transfer portions for different colors 32Y, 32C, 32M, and 32B. Then, as the intermediate transfer belt 31 rotates, the toner images on the four image forming portions 20 are sequentially superposed on each other and thereby transferred to the intermediate transfer belt 31 with predetermined timing. In this way, a color toner image with the toner images of four colors, namely yellow, cyan, magenta, and black, superposed together is formed on the outer circumferential face of the intermediate transfer belt 31.

The color toner image on the outer circumferential face of the intermediate transfer belt 31 is transferred to a sheet S conveyed in synchronism by the sheet conveying portion 4 at the secondary transfer nips formed in the secondary transfer portion 33. The belt cleaning portion 34, after secondary transfer, performs cleaning by removing toner and the like left on the outer circumferential face of the intermediate transfer belt 31.

The fixing portion 6 is arranged above the secondary transfer portion 33. The fixing portion 6 heats and presses the sheet S having the toner image transferred to it to fix the toner image to the sheet S.

The sheet discharge portion 7 is arranged above the transfer portion 30. The sheet S having the toner images fixed to it and thus having undergone printing is conveyed to the sheet discharge portion 7.

The control portion 8 includes a CPU, an image processing portion, a storage portion, and other electronic circuits and components (none of these are illustrated). The CPU, based on control programs and data stored in the storage portion, controls the operation of different components provided in the image forming apparatus 1 to perform processing related to the functions of the image forming apparatus 1. The sheet feeding portion 3, the sheet conveying portion 4, the exposure portion 5, the image forming portion 20, the transfer portion 30, and the fixing portion 6 individually receive commands from the control portion 8 and coordinate to perform printing on the sheet S. The storage portion is composed of a combination of, for example, a non-volatile storage device such as a program ROM (read-only memory) and a data ROM and a volatile storage device such as a RAM (random-access memory).

Next, the construction of and around the developing device 40 will be described with reference to FIG. 3. The developing devices 40 for different colors have basically a similar structure; thus, for their components, the suffixes distinguishing different colors will be omitted and no overlapping description will be repeated.

The developing device 40 feeds toner to the outer circumferential face of the photosensitive drum 21. The developing device 40 includes a developer container 41, a first stirring/conveying member 42, a second stirring/conveying member 43, a developing roller 44, and a regulating member 45.

The developer container 41 is in an elongate shape extending in the axial direction of the photosensitive drum 21 (i.e., in the depth direction with respect to the plane of FIG. 3), and is arranged with its longitudinal direction aligned horizontally. The developer container 41 stores, as developer, for example, magnetic one-component developer containing magnetic toner. Developer may instead be, for example, non-magnetic one-component developer or two-component developer containing toner and magnetic carrier. The developer container 41 includes a partition portion 411, a first conveying chamber 412, and a second conveying chamber 413.

The partition portion 411 is provided in a lower part inside the developer container 41. The partition portion 411 is provided in the lower part of the developer container 41, substantially in a middle part of it in the direction (the left-right direction in FIG. 3) intersecting with the axial direction, and extends in the axial and up-down directions. The partition portion 411 divides the inside of the developer container 41 in the direction (the left-right direction in FIG. 3) intersecting with the axial direction. The developer container 41 has, in opposite end parts of the partition portion 411 in the axial direction (the depth direction with respect to the plane of FIG. 3), a communication portion (not shown) between the first and second conveying chambers 412 and 413.

The first and second conveying chambers 412 and 413 are provided inside the developer container 41. The first and second conveying chambers 412 and 413 are formed by partitioning the inside of the developer container 41 with the partition portion 411 and are arranged side by side. The second conveying chamber 413 is arranged inside the developer container 41, adjacently below the region in which the developing roller 44 is arranged. The first conveying chamber 412 is arranged inside the developer container 41, in a region farther away from the developing roller 44 than the second conveying chamber 413. The first conveying chamber 412 is supplied with toner via a supply pipe connecting portion 412*a* shown in FIG. 3.

The first stirring/conveying member 42 is arranged inside the first conveying chamber 412. The second stirring/conveying member 43 is arranged inside the second conveying chamber 413. The second stirring/conveying member 43 is located close to the developing roller 44 and extends parallel to it. The first and second stirring/conveying members 42 and 43 are supported on the developer container 41 so as to be rotatable about axes that extend parallel to the photosensitive drum 21. The first and second stirring/conveying members 42 and 43, by rotating about their axes, stir and convey developer in opposite directions along the axial direction of their rotation.

As the first and second stirring/conveying members 42 and 43 rotate, developer circulates between the first and second conveying chambers 412 and 413 via the communication portions arranged in the opposite end parts of the partition portion 411 in the axial direction. In the first and second conveying chambers 412 and 413, toner fed from outside is stirred and electrostatically charged.

The developing roller 44 is arranged inside the developer container 41, above the second stirring/conveying member 43. The developing roller 44 is supported on the developer container 41 so as to be rotatable about an axis that extends parallel to the axis of the photosensitive drum 21. The developing roller 44 includes, for example, a cylindrical developing sleeve that rotates counter-clockwise in FIG. 3 and a developing roller-side magnetic pole that is fixed inside the developing sleeve (neither is shown).

Part of an outer circumferential face of the developing roller 44 is exposed out of the developer container 41 so as to face the photosensitive drum 21 in proximity to it. In a region of the developing roller 44 opposite the photosensitive drum 21, the developing roller 44 holds on its outer circumferential face the toner to be fed to the outer circumferential face of the photosensitive drum 21. The developing roller 44 attaches the toner in the second conveying chamber 413 to the electrostatic latent image on the outer circumferential face of the photosensitive drum 21 to form a toner image.

The regulating member 45 is arranged in a region where the developing roller 44 and the photosensitive drum 21 face each other, upstream of the developing roller 44 in its rotation direction. The regulating member 45 is arranged opposite the developing roller 44 in proximity to it with a predetermined distance left between its tip end and the outer circumferential face of the developing roller 44. The regulating member 45 extends over the entire region of the developing roller 44 in the axial direction (the depth direction with respect to the plane of FIG. 3). The regulating member 45 regulates the layer thickness of developer (toner) held on the outer circumferential face of the developing roller 44.

The toner in the developer container 41 is stirred, circulated, and electrostatically charged in the first and second conveying chambers 412 and 413, and is then passed to the outer circumferential face of the developing roller 44 by the second stirring/conveying member 43. Having its layer thickness regulated by the regulating member 45, the toner, as the developing roller 44 rotates, is conveyed to the region where the developing roller 44 and the photosensitive drum 21 face each other. When a predetermined developing voltage is applied to the developing roller 44, due to the potential difference from that on the outer circumferential face of the photosensitive drum 21, the toner held on the outer circumferential face of the developing roller 44 flies through the developing space toward the outer circumferential face of the photosensitive drum 21, thereby the electrostatic latent image on the outer circumferential face of the photosensitive drum 21 is developed.

Figure 4:
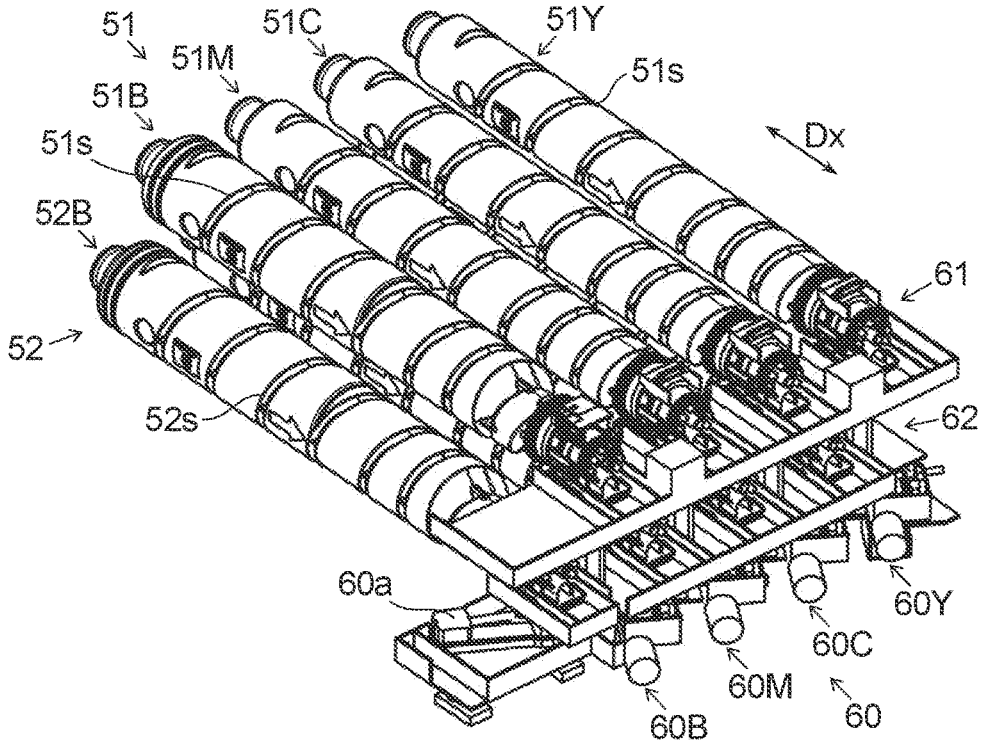
FIG. 4 is a perspective view of and around a toner supply device in the image forming apparatus in FIG. 1.

In connection with the supply of toner to the developing device 40, the image forming apparatus 1 includes a first container 51, a second container 52, and a toner supply device 60 (see FIG. 4). The first and second containers 51 and 52 and the toner supply device 60 are arranged above the developing device 40. The first and second containers 51 and 52 and the toner supply device 60 are provided one of each for each of four colors of yellow, cyan, magenta, and black.

Figure 5:
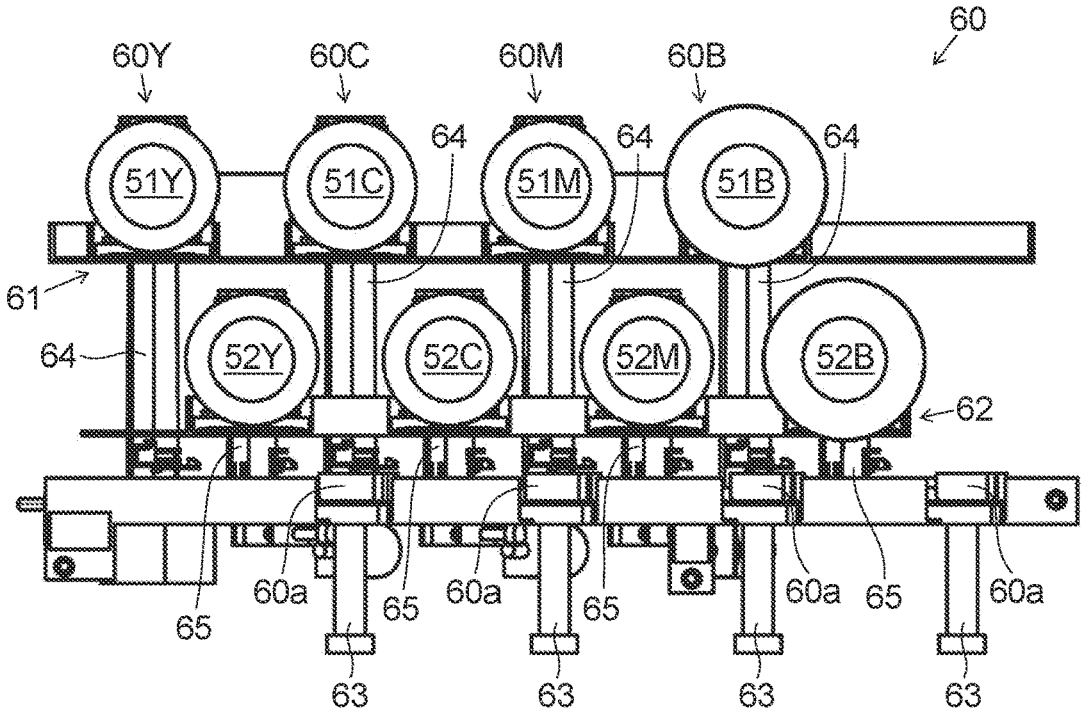
FIG. 5 is a front view of and around the toner supply device in FIG. 4.
Figure 6:
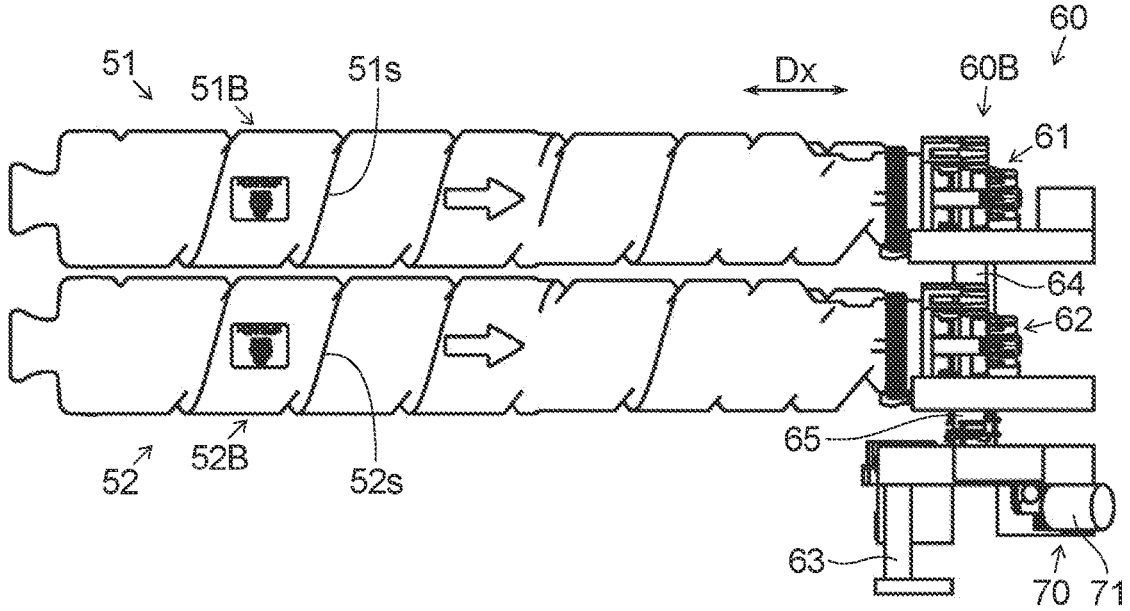
FIG. 6 is a side view of and around the toner supply device in FIG. 4.
Figure 7:
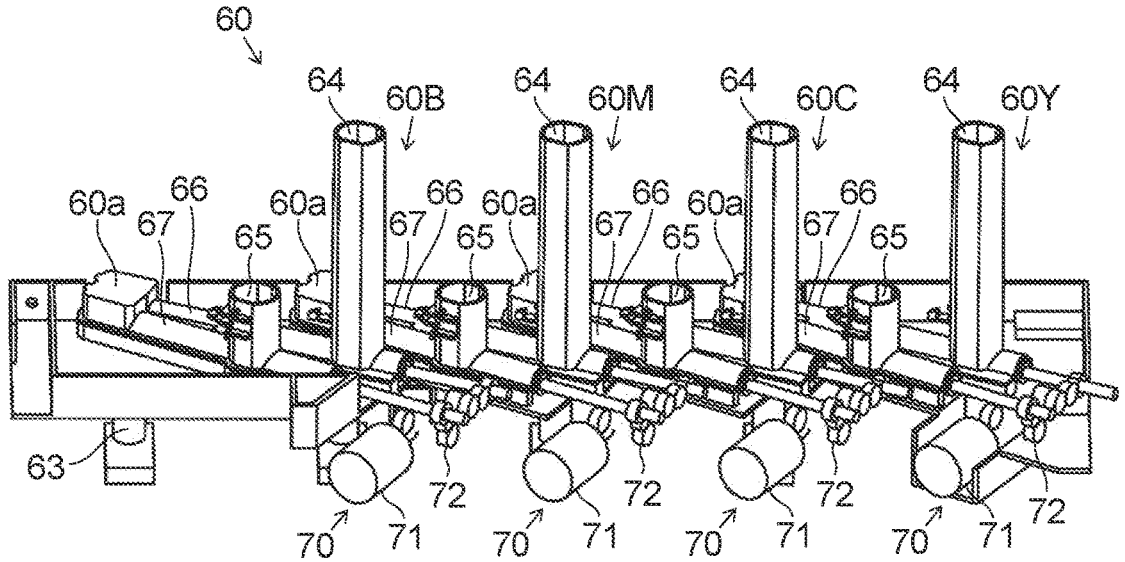
FIG. 7 is a perspective view of the toner supply device in FIG. 4.
Figure 8:
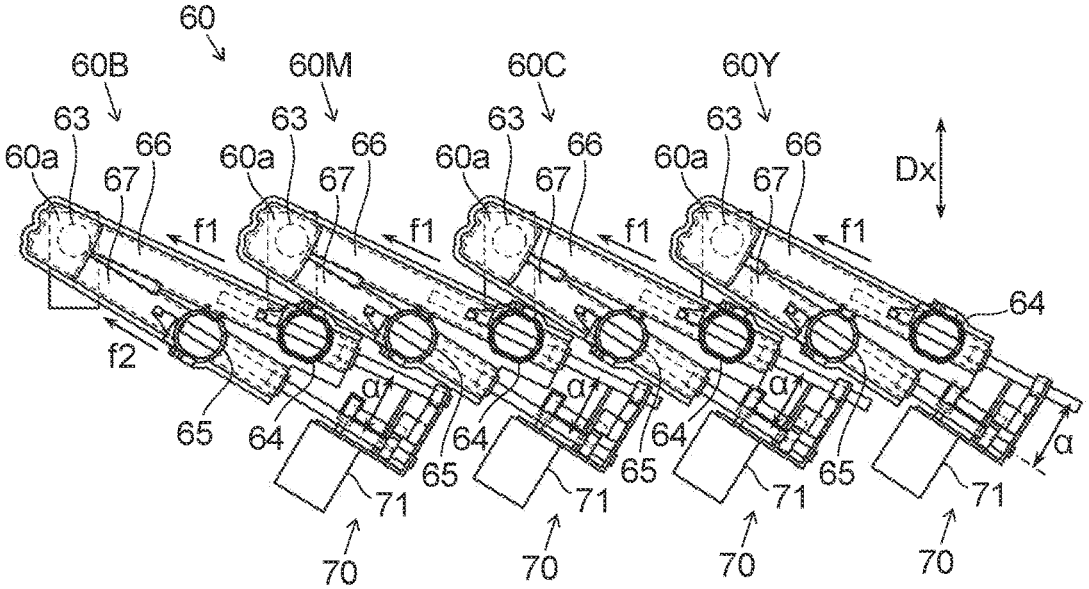
FIG. 8 is a plan view of the toner supply device in FIG. 4.
Figure 9:
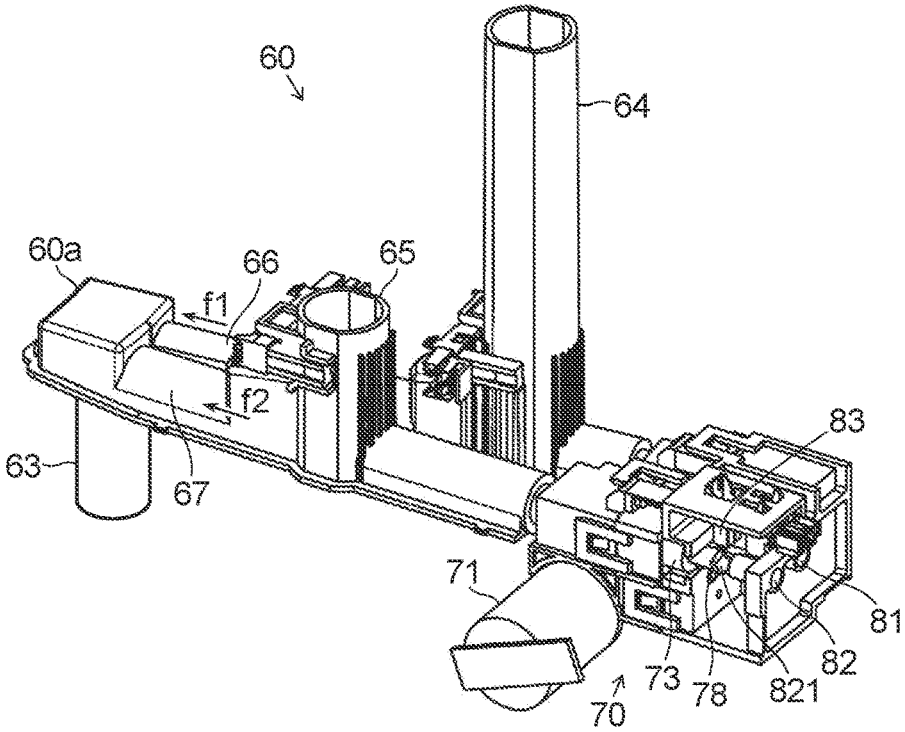
FIG. 9 is a perspective view of a first conveying pipe, a second conveying pipe, and a conveying driving portion in the toner supply device in FIG. 7.
Figure 10:
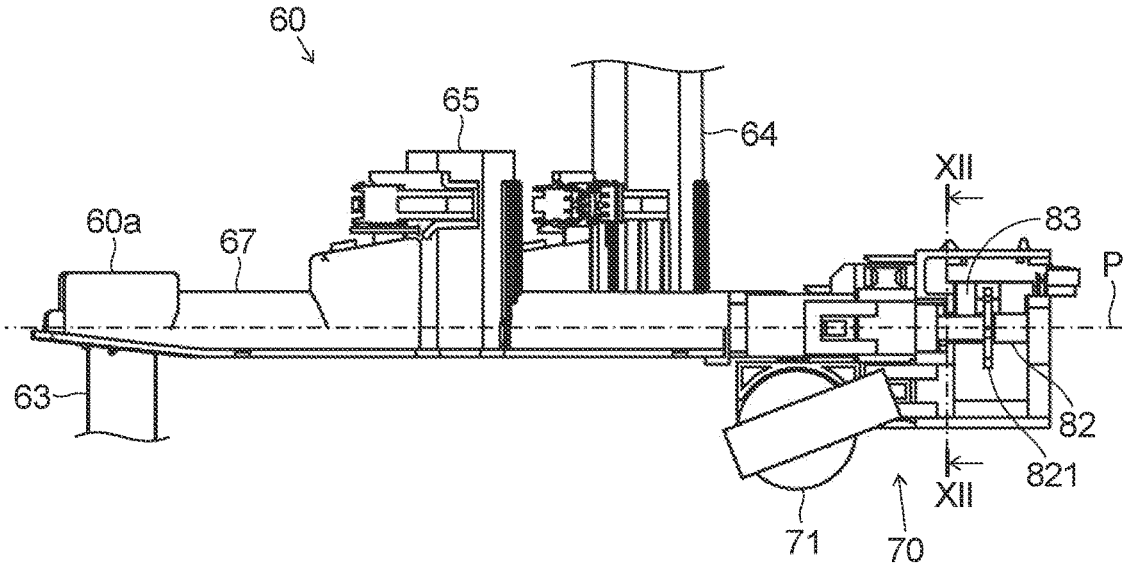
FIG. 10 is a side view of the first and second conveying pipes and the conveying driving portion in the toner supply device in FIG. 7.
Figure 11:
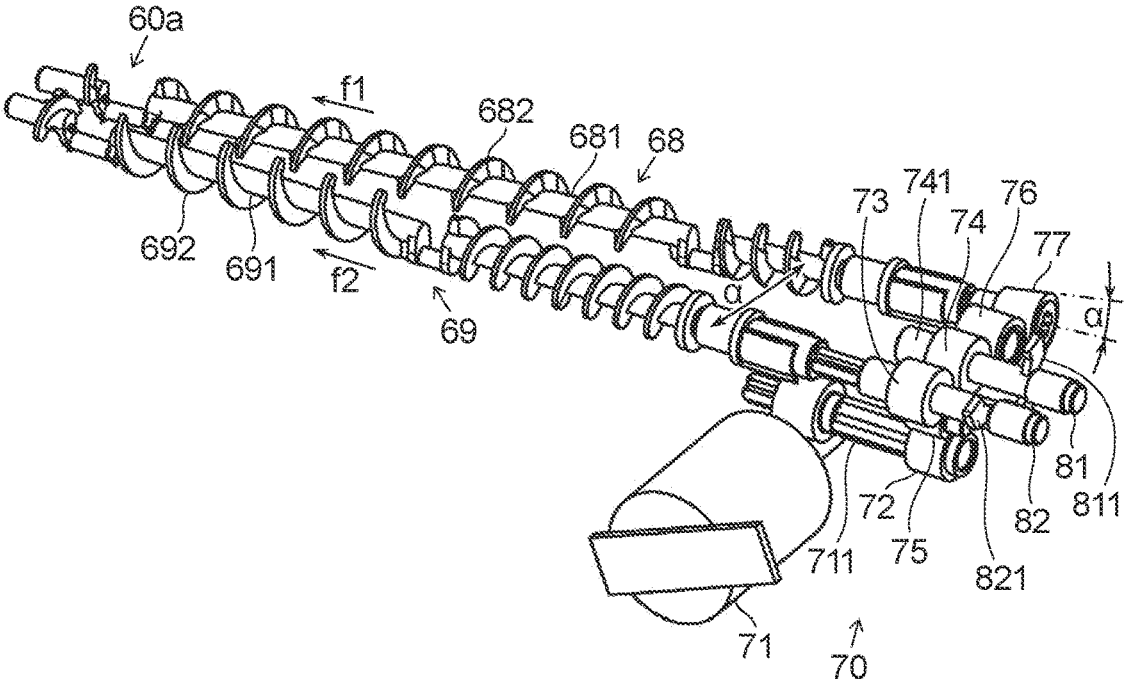
FIG. 11 is a perspective view of a first conveying member, a second conveying member, and the conveying driving portion in the toner supply device in FIG. 9.
Figure 12:
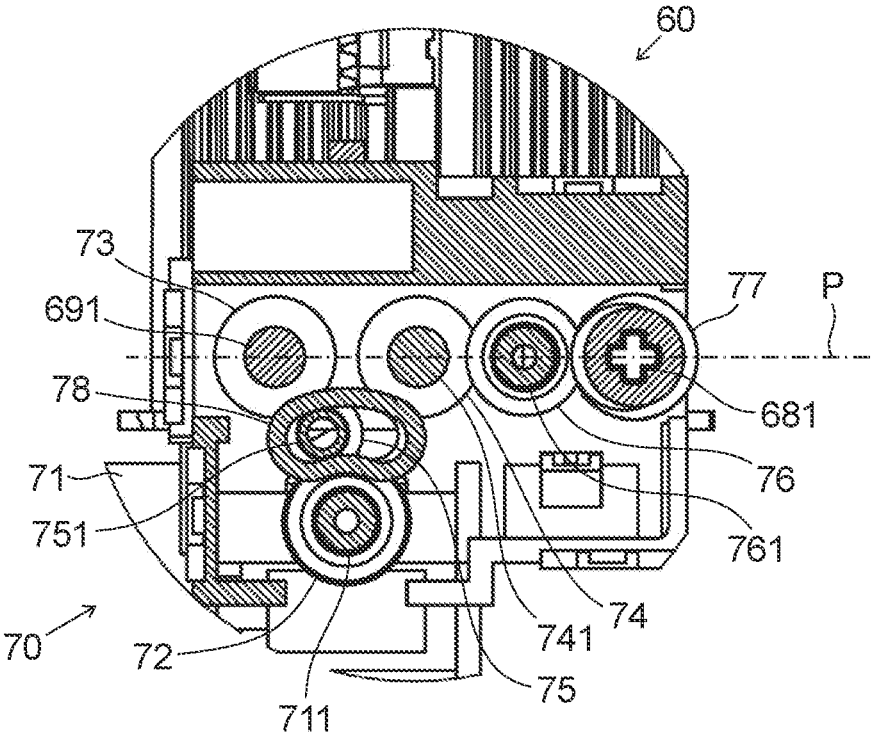
FIG. 12 is a sectional back view of and around the conveying driving portion in the toner supply device in FIG. 10.

Next, the construction of and around the toner supply device 60 will be described with reference to FIGS. 4 to 12. FIG. 4 is a perspective view of and around the toner supply device 60 in the image forming apparatus 1 in FIG. 1. FIGS. 5 and 6 are a front view and a side view, respectively, of and around the toner supply device 60 in FIG. 4. FIGS. 7 and 8 are a perspective view and a plan view, respectively, of and around the toner supply device 60 in FIG. 4. FIGS. 9 and 10 are a perspective view and a side view, respectively, of a first conveying pipe 66 and a second conveying pipe 67 in the toner supply device 60 in FIG. 7. FIG. 11 is a perspective view of a first conveying member 68 and a second conveying member 69 in the toner supply device 60 in FIG. 9. FIG. 12 is a sectional back view of and around a conveying driving portion 70 in the toner supply device 60 in FIG. 10.

The first container 51, the second container 52, and the toner supply device 60 include the following: a first and a second container 51Y and 52Y and a toner supply device 60Y for yellow; a first and a second container 51C and 52C and a toner supply device 60C for cyan; a first and a second container 51M and 52 M and a toner supply device 60M for magenta; and a first and a second container 51B and 52B and a toner supply device 60B for black. The first and second containers 51 and 52 and the toner supply device 60 for different colors have basically a similar structure. Thus, in the following description, the suffixes "Y", "C", "M", and "B" distinguishing different colors are often omitted, unless distinction is needed.

The first container 51 is arranged above the second container 52. The second container 52 is arranged below the first container 51. The first and second containers 51 and 52 are arranged, as seen from in front, deviated from each other in the array direction of the image forming portions 20 and the toner supply devices 60. The first and second containers 51 and 52 are removable from the main body 2 and stores toner to be supplied to the developing device 40.

The first and second containers 51 and 52 are in an elongate cylindrical shape extending in the axial direction Dx of the photosensitive drum 21, and are arranged with their longitudinal direction aligned horizontally. Formed on the circumference wall of the first and second containers 51 and 52 are helical projecting portions 51*s* and 52*s* that project inward in the radial direction and that extend in the longitudinal direction.

The first and second containers 51 and 52 are each closed at one end (front side) in the axial direction Dx and each have an opening (not shown) at the other end (rear side) in the axial direction Dx. The first and second containers 51 and 52 are, at the rear side, i.e., open side, that is open, respectively connected to a first container connecting portion 61 and a second container connecting portion 62 in the toner supply device 60. The first and second containers 51 and 52 are supported on the toner supply device 60 so as to be rotatable about their axes that extend parallel to the axial direction Dx of the photosensitive drum 21.

The first and second containers 51 and 52 are rotated by a driver (not shown) about their axes that extend parallel to the axial direction Dx of the photosensitive drum 21. As the first and second containers 51 and 52 rotate, the toner inside is conveyed by the helical projecting portions 51*s* and 52*s* toward the rear side, i.e., open side. Thus, the toner in the first and second containers 51 and 52 flows into the toner supply device 60 through the opening.

The toner supply device 60 is arranged at the rear side of the first and second containers 51 and 52. The four toner supply devices 60 are arranged in a row in the same order as the four image forming portions 20. The toner supply device 60 supplies the toner in the first and second containers 51 and 52 to the developing device 40.

The toner supply device 60 includes the first and second container connecting portions 61 and 62, a supply pipe 63, a first and a second vertical pipe 64 and 65, the first and second conveying pipes 66 and 67, the first and second conveying members 68 and 69, the conveying driving portion 70, and a rotation sensing portion 80.

The first container connecting portion 61 is arranged in an upper part of the toner supply device 60, above the second container connecting portion 62. The first container connecting portion 61 has a toner circulation path (not shown) inside. The first container connecting portion 61 is connected to the first container 51 at its open side and rotatably supports the first container 51. The downstream end of the first container connecting portion 61 in the toner circulation direction is connected to the first vertical pipe 64. When the toner in the first container 51 is supplied to the developing device 40, the toner flows from the first container 51 into the first container connecting portion 61 and then flows through and then out of the first container connecting portion 61 toward the first vertical pipe 64.

The second container connecting portion 62 is arranged in an upper part of the toner supply device 60, below the first container connecting portion 61. The second container connecting portion 62 has a toner circulation path (not shown) inside. The second container connecting portion 62 is connected to the second container 52 at its open side and rotatably supports the second container 52. The downstream end of the second container connecting portion 62 in the toner circulation direction is connected to the second vertical pipe 65. When the toner in the second container 52 is supplied to the developing device 40, the toner flows from the second container 52 into the second container connecting portion 62 and then flows through and then out of the second container connecting portion 62 toward the second vertical pipe 65.

The supply pipe 63 is arranged in a lower part of the toner supply device 60. The toner supply device 60 includes the single supply pipe 63. The supply pipe 63 is formed in a cylindrical shape extending in the up-down direction. The top end of the supply pipe 63 is connected to a confluence portion 60*a* of the first and second conveying pipes 66 and 67. The bottom end of the supply pipe 63 is connected to the supply pipe connecting portion 412*a* in the developing device 40. When the toner in the first and second containers 51 and 52 is supplied to the developing device 40, the toner flows via the confluence portion 60*a* into the supply pipe 63 and then flows through the supply pipe 63 into the developing device 40.

The first vertical pipe 64 is arranged between the first container connecting portion 61 and the first conveying pipe 66. The first vertical pipe 64 is formed in a cylindrical shape extending in the up-down direction. The top end of the first vertical pipe 64 is connected to the first container connecting portion 61. The bottom end of the first vertical pipe 64 is connected to the first conveying pipe 66. When the toner in the first container 51 is supplied to the developing device 40, the toner flows via the first container connecting portion 61 into the first vertical pipe 64 and then flows through and then out of the first vertical pipe 64 toward the first conveying pipe 66.

The second vertical pipe 65 is arranged between the second container connecting portion 62 and the second conveying pipe 67. The second vertical pipe 65 is formed in a cylindrical shape extending in the up-down direction. The top end of the second vertical pipe 65 is connected to the second container connecting portion 62. The bottom end of the second vertical pipe 65 is connected to the second conveying pipe 67. When the toner in the second container 52 is supplied to the developing device 40, the toner flows via the second container connecting portion 62 into the second vertical pipe 65 and then flows through and then out of the second vertical pipe 65 toward the second conveying pipe 67.

Since the first container 51 and the first container connecting portion 61 are arranged above the second container 52 and the second container connecting portion 62, the first vertical pipe 64 is longer in the up-down direction than the second vertical pipe 65. Since the second container 52 and the second container connecting portion 62 are arranged below the first container 51 and the first container connecting portion 61, the second vertical pipe 65 is shorter in the up-down direction than the first vertical pipe 64. The first and second vertical pipes 64 and 65 are arranged at the same position in the axial direction Dx of the photosensitive drum 21. In other words, the first and second vertical pipes 64 and 65 are arranged side by side along a straight line perpendicular to the axial direction Dx.

The first conveying pipe 66 is arranged between the first vertical pipe 64 and the supply pipe 63 in the up-down direction. The first conveying pipe 66 is formed in a cylindrical shape extending in the horizontal direction. To one end of the first conveying pipe 66 in its extending direction, the first vertical pipe 64 is connected. The other end of the first conveying pipe 66 in its extending direction is connected to the confluence portion 60*a* When the toner in the first container 51 is supplied to the developing device 40, the toner flows from the first vertical pipe 64 into the first conveying pipe 66 and then flows through and then out of the first conveying pipe 66 toward the confluence portion 60*a*. In other words, the first conveying pipe 66 is connected between the first container 51 and the supply pipe 63, and the toner is conveyed from the first container 51 toward the supply pipe 63.

The second conveying pipe 67 is arranged between the second vertical pipe 65 and the supply pipe 63 in the up-down direction. The second conveying pipe 67 is formed in a cylindrical shape extending in the horizontal direction. To one end of the second conveying pipe 67 in its extending direction, the second vertical pipe 65 is connected. The other end of the second conveying pipe 67 in its extending direction is connected to the confluence portion 60*a*. When the toner in the second container 52 is supplied to the developing device 40, the toner flows from the second vertical pipe 65 into the second conveying pipe 67 and then flows through and then out of the second conveying pipe 67 toward the confluence portion 60*a*. In other words, the second conveying pipe 67 is connected between the second container 52 and the supply pipe 63, and the toner is conveyed from the second container 52 toward the supply pipe 63.

The first and second conveying pipes 66 and 67 are arranged so that their respective extension lines intersect with each other at their confluence portion 60*a* sides with respect to their extending directions. In other words, the first and second conveying pipes 66 and 67 are arranged such that the angle between their extending directions is an acute angle in the horizontal direction, that is, in a V-shape as seen from the up-down direction.

The first conveying member 68 is arranged inside the first conveying pipe 66. The first conveying member 68 includes a rotary shaft 681 that is provided between opposite ends of the cylindrical first conveying pipe 66 in the axial direction and a first conveying blade 682 that is formed on the outer circumferential surface of the rotary shaft 681 and extends in a helical shape along the axial direction. The first conveying member 68 is supported inside the first conveying pipe 66 so as to be rotatable about an axis that extends in the horizontal direction. One end part of the first conveying member 68 in the axial direction is located in the confluence portion 60*a*.

The first conveying member 68, as it rotates about the axis, stirs and conveys the toner in the first conveying pipe 66 along the toner conveying direction f1 (see FIGS. 8, 9, and 10) that is parallel to the rotation axis. The first conveying member 68 conveys the toner in the first conveying pipe 66 from the first vertical pipe 64 toward the confluence portion 60*a*. In other words, the first conveying member 68 conveys the toner from the first container 51 toward the supply pipe 63.

The second conveying member 69 is arranged inside the second conveying pipe 67. The second conveying member 69 includes a rotary shaft 691 that is provided between opposite ends of the cylindrical second conveying pipe 67 in the axial direction and a second conveying blade 692 that is formed on the outer circumferential surface of the rotary shaft 691 and extends in a helical shape along the axial direction. The second conveying member 69 is supported inside the second conveying pipe 67 so as to be rotatable about the axis that extends in the horizontal direction. One end part of the second conveying member 69 in the axial direction is located in the confluence portion 60*a*.

The second conveying member 69, as it rotates about the axis, stirs and conveys the toner in the second conveying pipe 67 along the toner conveying direction f2 (see FIGS. 8, 9, and 10) that is parallel to the rotation axis. The second conveying member 69 conveys the toner in the second conveying pipe 67 from the second vertical pipe 65 toward the confluence portion 60*a* In other words, the second conveying member 69 conveys the toner from the second container 52 toward the supply pipe 63.

The first and second conveying pipes 66 and 67 are, as mentioned above, arranged in a V-shape as seen from the up-down direction. That is, the rotary shaft 681 of the first conveying member 68 and the rotary shaft 691 of the second conveying member 69 are arranged so as to form a predetermined axial angle $\alpha$.

The conveying driving portion 70 is arranged in a rear part of the toner supply device 60, upstream of the first and second conveying pipes 66 and 67 in the toner conveying direction. The conveying driving portion 70 includes a motor 71, a first gear 72, a second gear 73, a third gear 74, a swing gear 75, an idle gear 76, and a fourth gear 77.

The motor 71 generates a driving force for rotating the first and second conveying members 68 and 69. The motor 71 is controlled by the control portion 8. To the motor 71, an output shaft 711 is coupled. The output shaft 711 is arranged below the second conveying member 69 and extends parallel to the rotary shaft 691 of the second conveying member 69.

The first gear 72 is fixed to the output shaft 711 of the motor 71. The first gear 72 is located below the second gear 73, the third gear 74, and the swing gear 75. The first gear 72 is rotated by the motor 71. The first gear 72 meshes with the swing gear 75 to transmit the driving force of the motor 71 to the swing gear 75.

The second gear 73 is located above the swing gear 75. The second gear 73 is fixed coaxially with the rotary shaft 691 of the second conveying member 69. The second gear 73 receives the driving force of the motor 71 from the swing gear 75 to rotate together with the second conveying member 69.

The third gear 74 is located above the swing gear 75. The third gear 74 is arranged away from, parallel to, the second gear 73. The third gear 74 is located closer, than the second gear 73, to the first conveying member 68. The third gear 74 receives the driving force of the motor 71 from the swing gear 75 to rotate.

The swing gear 75 is located above the first gear 72, below the second and third gears 73 and 74. The swing gear 75 stays in mesh with the first gear 72 all the time. The rotary shaft 751 of the swing gear 75 is rotatably supported inside an arcuate guide 78. The arcuate guide 78 is formed in an arcuate shape extending in the circumferential direction of the first gear 72. Thus, the swing gear 75 meshes with the first gear 72 to swing on its outer circumference. The swing gear 75, by swinging, selectively meshes with one of the second and third gears 73 and 74. The swing gear 75 transmits the driving force of the motor 71 received via the first gear 72 to one of the second and third gears 73 and 74.

The idle gear 76 is arranged between the third and fourth gears 74 and 77. The idle gear 76 meshes with both the third and fourth gears 74 and 77. The idle gear 76 transmits the driving force of the motor 71 received via the third gear 74 to the fourth gear 77.

The fourth gear 77 is fixed coaxially with the rotary shaft 681 of the first conveying member 68. The fourth gear 77 meshes with the idle gear 76. The rotary shaft 761 of the idle gear 76 is parallel to the rotary shaft of the second gear 73 (the rotary shaft 691 of the second conveying member 69). That is, the fourth gear 77 is a gear that has an axial angle α between the input shaft (the rotary shaft 761 of the idle gear 76) and the output shaft (the rotary shaft 681 of the first conveying member 68).

When the motor 71 is driven to rotate the first gear 72 clockwise in FIG. 12, the swing gear 75 receives the driving force from the first gear 72 to rotate, and moves, along the arcuate guide 78, on the outer circumference of the first gear 72 clockwise in FIG. 12. Thus, the swing gear 75 meshes with the third gear 74 to transmit the driving force of the motor 71 to the third gear 74. The driving force of the motor 71 that has been transmitted to the third gear 74 is transmitted to the fourth gear 77 via the idle gear 76. The first conveying member 68 is then rotated by the conveying driving portion 70 via the fourth gear 77 to convey the toner in the toner conveying direction f1. On the other hand, the second conveying member 69 stops rotating.

When the motor 71 is driven to rotate the first gear 72 counterclockwise in FIG. 12, the swing gear 75 receives the driving force from the first gear 72 to rotate, and moves, along the arcuate guide 78, on the outer circumference of the first gear 72 counterclockwise in FIG. 12. Thus, the swing gear 75 meshes with the second gear 73 to transmit the driving force of the motor 71 to the second gear 73. The second conveying member 69 is then rotated by the conveying driving portion 70 via the second gear 73 to convey the toner in the toner conveying direction f2. On the other hand, the first conveying member 68 stops rotating.

In this way, the conveying driving portion 70 rotates one of the first and second conveying members 68 and 69 selectively.

According to the above construction, the first and second conveying members 68 and 69 are arranged so as to form a predetermined axial angle α; thus it is possible to efficiently convey the toner toward the single supply pipe 63. In addition, with a minimum structure composed of a combination of six gears, the conveying driving portion 70 can selectively drive one of the first and second conveying members 68 and 69. Thus, the image forming apparatus 1 is configured to be able to efficiently supply toner from the two containers to the single developing device 40, and this helps reduce cost and size.

For example, the fourth gear 77 is a conical gear of which the tooth top faces and the tooth bottom faces lie on a conical surface. The angle formed by the generatrix of the conical surface and the rotation axis of the first conveying member 68 equals the axial angle α. With this construction, even when there is an axial angle α between the rotary shaft 681 of the first conveying member 68 and the rotary shaft 691 of the second conveying member 69, it is possible to make the idle gear 76, which is a flat gear, mesh with the fourth gear 77. In this way, it is possible to reduce the number of gears in the gear train between the third and fourth gears 74 and 77, and this helps avoid a complex gear structure.

In addition, as shown in FIG. 12, the rotation axes of the second gear 73, the third gear 74, the idle gear 76, and the fourth gear 77 lie on the plane P including the rotation axes of the first and second conveying members 68 and 69. With this construction, the driving force of the motor 71 transmitted from the swing gear 75 to the second and third gears 73 and 74 can be transmitted to the first and second conveying members 68 and 69 evenly. Thus, the toner conveyance performance of the first and second conveying members 68 and 69 can be stabilized evenly.

In addition, as shown in FIG. 12, the swing gear 75 is located below the second and third gears 73 and 74. With this construction, it is possible to mesh with more ease the swing gear 75 that swings on the outer circumference of the first gear 72 with the second and third gears 73 and 74. This makes it possible to smoothly switch the transmission of the driving force between the first and second conveying members 68 and 69. Thus, it is possible to efficiently supply the toner to the developing device 40.

The second gear 73, the third gear 74, the idle gear 76, and the fourth gear 77 all have the same number of teeth. With this structure, it is possible to easily make the number of revolutions equal between the first and second conveying members 68 and 69. Thus, it is possible to easily make the toner conveying force equal between the first and second conveying members 68 and 69.

The rotation sensing portion 80 is arranged in a rear part of the toner supply device 60, upstream of the second conveying pipe 67 in the toner conveying direction with respect to the conveying driving portion 70. The rotation sensing portion 80 includes a first sensing shaft 81, a second sensing shaft 82, and an optical sensor 83.

The first sensing shaft 81 is connected coaxially with, so as to extend, the rotary shaft 741 of the third gear 74. The first sensing shaft 81 is coupled to the first conveying member 68 via the third gear 74, the idle gear 76, and the fourth gear 77 and rotates together with the first conveying member 68. The first sensing shaft 81 rotates in the same direction and at the same speed as the first conveying member 68. The first sensing shaft 81 is, in this embodiment, located adjacent to the second sensing shaft 82 and extends parallel to the second sensing shaft 82.

The first sensing shaft 81 includes, for example, two first light-shielding plates 811. The two first light-shielding plates 811 extend outward in the radial direction of the first sensing shaft 81 and are arrayed at angular intervals of 180 degrees from each other in the circumferential direction. As the first sensing shaft 81 rotates, the first light-shielding plate 811 moves into and out of the optical path of the optical sensor 83.

The second sensing shaft 82 is connected coaxially with, so as to extend, the rotary shaft of the second gear 73. The second gear 73 is fixed coaxially with the rotary shaft 691 of the second conveying member 69. That is, the second sensing shaft 82 is coupled to the second conveying member 69 and rotates together with the second conveying member 69. The second sensing shaft 82 rotates in the same direction and at the same speed as the second conveying member 69.

The second sensing shaft 82 includes, for example, two second light-shielding plates 821. The two second light-shielding plates 821 extend outward in the radial direction of the second sensing shaft 82 and are arrayed at angular intervals of 180 degrees from each other in the circumferential direction. As the second sensing shaft 82 rotates, the second light-shielding plate 821 moves into and out of the optical path of the optical sensor 83.

The optical sensor 83 is arranged above between the first and second sensing shafts 81 and 82. The rotation sensing portion 80 includes the single optical sensor 83. The optical sensor 83 is, for example, a transmission type sensor. It includes a light emitting portion and a light receiving portion (neither is shown) and has an optical path passing from the light emitting portion to the light receiving portion. The optical sensor 83 senses whether the optical path is blocked (light-shielded) or not blocked (light-transmitted).

The first light-shielding plate 811 of the first sensing shaft 81 and the second light-shielding plate 821 of the second sensing shaft 82 move into and out of the optical path of the optical sensor 83. Thus, the optical sensor 83 senses the rotation of the first and second sensing shafts 81 and 82. That is, the optical sensor 83 senses the rotation of the second and third gears 73 and 74. The optical sensor 83 outputs to the control portion 8 a signal related to the sensed rotation of the second and third gears 73 and 74.

The control portion 8 receives the output signal of the optical sensor 83. The control portion 8 has a remaining quantity sensing portion 8*a* shown in FIG. 2. The function of the remaining quantity sensing portion 8*a* is achieved on a software basis by the CPU performing arithmetic operation in accordance with a program stored in the storage portion. The remaining quantity sensing portion 8*a* may be configured as an electrical hardware circuit.

The remaining quantity sensing portion 8*a*, based on the output signal of the optical sensor 83, senses the remaining quantity of toner in the first and second containers 51 and 52. More specifically, the remaining quantity sensing portion 8*a* counts the number of revolutions of the second and third gears 73 and 74 based on the output signal of the optical sensor 83 and, based on the number of revolutions, senses the remaining quantity of the toner in the first and second containers 51 and 52.

The remaining quantity sensing portion 8*a* counts the number of revolutions of the third gear 74 (the first conveying member 68) based on the output signal of the optical sensor 83 and, based on the number of revolutions, senses the toner in the first container 51 being empty. The control portion 8 controls the motor 71 to stop the rotation of the first conveying member 68 and thereby stops the supply of toner from the first container 51 to the developing device 40. Next, the control portion 8 rotates the motor 71 reversely to rotate the second gear 73 (the second conveying member 69) and thereby starts the supply of toner from the second container 52 to the developing device 40.

Similarly, the remaining quantity sensing portion 8*a* senses the toner in the second container 52 being empty based on the number of revolutions of the second gear 73 (second conveying member 69). Next, the control portion 8 controls the motor 71 to rotate the third gear 74 (the first conveying member 68) and thereby start the supply of toner from the first container 51 to the developing device 40.

According to the above construction, with the single optical sensor 83, it is possible to separately detect the rotation of the second gear 73 (the second conveying member 69) and the third gear 74 (the first conveying member 68). Thus, with a cost- and size-reduced construction, it is possible to accurately detect the remaining quantity of toner in the two containers (first and second containers 51 and 52) that supply toner to the single developing device 40.

The description given above of embodiments of the present disclosure is in no way meant to limit the scope of the present disclosure; the present disclosure can be implemented with any modifications made without departing from the spirit of the present disclosure.

For example, while in the embodiment described above, the image forming apparatus 1 is assumed to be a color-printing image forming apparatus of what is called a tandem type in which images of a plurality of colors are formed so as to be sequentially superposed on each other, this is not meant as any limitation to that and similar types. The image forming apparatus may be a color-printing image forming apparatus of any type other than a tandem type, or may be an image forming apparatus for monochrome printing.

What is claimed is:

1. An image forming apparatus comprising:

a developing device that supplies toner to an image carrying member;

a first container and a second container that store the toner to be supplied to the developing device; and a toner supply device that supplies the toner in the first and second containers to the developing device, wherein the toner supply device includes a single supply pipe that is connected to the developing device and through which the toner flows into the developing device, a first conveying pipe that is connected between the first container and the supply pipe and through which the toner is conveyed from the first container toward the supply pipe, a second conveying pipe that is connected between the second container and the supply pipe and through which the toner is conveyed from the second container toward the supply pipe, a first conveying member that is rotatably arranged in the first conveying pipe, the first conveying member conveying the toner from the first container toward the supply pipe, a second conveying member that is rotatably arranged in the second conveying pipe, the second conveying member conveying the toner from the second container toward the supply pipe, and a conveying driving portion that rotates selectively one of the first and second conveying members, wherein a rotary shaft of the first conveying member and a rotary shaft of the second conveying member are arranged so as to form a predetermined axial angle, and the conveying driving portion includes a motor that rotates the first and second conveying members, a first gear that is fixed to an output shaft of the motor, a second gear that is fixed coaxially with the rotary shaft of the second conveying member, a third gear that is arranged away from, parallel to, the second gear, a swing gear that meshes with the first gear, the swing gear meshing selectively with one of the second and third gears by swinging on an outer circumference of the first gear, an idle gear that meshes with the third gear, a fourth gear that has the axial angle between an input shaft and an output shaft, the fourth gear being fixed coaxially with the rotary shaft of the first conveying member to mesh with the idle gear;

a rotation sensing portion that has a single optical sensor that senses rotation of the second and third gears, and a remaining quantity sensing portion that counts a number of revolutions of the second and third gears based on an output signal of the optical sensor, the remaining quantity sensing portion sensing a remaining quantity of the toner in the first and second containers based on the number of revolutions.

2. The image forming apparatus according to claim 1, wherein the fourth gear is a conical gear of which tooth top faces and tooth bottom faces lie on a conical surface.

3. The image forming apparatus according to claim 1, wherein rotation axes of the second gear, the third gear, the idle gear, and the fourth gear lie on a plane that include rotation axes of the first and second conveying members.

4. The image forming apparatus according to claim 1, wherein the swing gear is located below the second and third gears.

5. The image forming apparatus according to claim 1, wherein the second gear, the third gear, the idle gear, and the fourth gear all have a same number of teeth.

* * * * *